US005299396A

United States Patent [19]

Raap et al.

[11] Patent Number: 5,299,396

[45] Date of Patent: * Apr. 5, 1994

[54] SUNROOF AND METHOD OF INSTALLING SAME

[75] Inventors: Daniel L. Raap, New Sharon; Mearl Minter, Oskaloosa, both of Iowa

[73] Assignee: Pella Corporation, Pella, Iowa

[ * ] Notice: The portion of the term of this patent subsequent to Apr. 16, 2008 has been disclaimed.

[21] Appl. No.: 682,910

[22] Filed: Apr. 9, 1991

Related U.S. Application Data

[63] Continuation-in-part of Ser. No. 342,094, Apr. 24, 1989, Pat. No. 5,007,215.

[51] Int. Cl.[5] ..... E04B 7/18; E04D 3/38

[52] U.S. Cl. ..... 52/90.1; 52/58; 52/200; 52/460; 52/463; 52/467

[58] Field of Search ..... 52/58, 79.6, 86, 74, 52/82, 90, 93, 460, 463, 464, 467, 468, 470, 471, 200; 47/17

[56] References Cited

U.S. PATENT DOCUMENTS

| | | | |
|---|---|---|---|
| 697,220 | 4/1902 | Staples . | |
| 2,166,108 | 7/1939 | Jensen . | |
| 3,314,203 | 4/1967 | Hill et al. . | |
| 4,228,791 | 10/1980 | Hirai et al. . | |
| 4,418,506 | 12/1983 | Weber et al. . | |
| 4,462,390 | 7/1984 | Holdridge et al. . | |
| 4,471,584 | 9/1984 | Dietrich . | |
| 4,583,333 | 4/1986 | Minter . | |
| 4,680,905 | 7/1987 | Rockar | 52/200 |
| 5,007,215 | 4/1991 | Minter | 52/90 |

*Primary Examiner*—Michael Safavi

*Attorney, Agent, or Firm*—Zarley, McKee, Thomte, Voorhees, & Sease

[57] ABSTRACT

Components for a multiple window unit sunroof are pre-assembled at the factory and include a support frame having vertical beam members which have water weep channels on their top faces for routing away from the sunroof moisture entering under the glazing panel adjacent side edges which overlap the drain channel. The support frame is snugly received in a boot. Removable locator jigs are attached to the perimeter frame of the glazing panels to position them and hold them while mounting flanges are being installed.

28 Claims, 5 Drawing Sheets

106
100
116
98
114
18
18
96
118
96
114
98
132
20
132
22
16
30
26
32
44
44
34
24
44
28
44
14
12

106
118
122
120
124
96
76
78
18
74
58
56
130
30
54
20
132
16
52
50
46
48
44
14
12

SUNROOF AND METHOD OF INSTALLING SAME

CROSS REFERENCE TO A RELATED APPLICATION

This application is a continuation-in-part of application Ser. No. 07/342,094 filed Apr. 24, 1989 now U.S. Pat. No. 5,007,215 by Mearl Minter and entitled SUNROOM.

BACKGROUND OF THE INVENTION

A sunroof which is of a sunroom is a very popular building feature. A skylight as disclosed in the Mearl Minter U.S. Pat. No. 4,972,638 utilizes a single glazing panel. What is needed is a sunroof utilizing glazing panels interconnected as disclosed in Mearl Minter U.S. Pat. No. 5,007,215 Apr. 16, 1991 assigned to Pella Corporation, Pella, Iowa. It is desirable to factory assemble as much of the sunroof as possible leaving a minimum amount of assembly for the job site. A sunroof assembly at the job site should be "installer friendly". The sunroof should include as many as four glazing panels and involve a composite frame readily mounted in a roof opening. A built-in water weep system should be provided. Installation jigs are desirable for assuring that the glazing panels are properly positioned on the supporting composite frame. The frame should be mounted in a protective boot.

SUMMARY OF THE INVENTION

Components for a leakproof sunroof including up to four glazing panels are assembled requiring a minimum of time and effort on the part of the installer at the job site. The individual frame and glazing panel components are packaged and shipped separately thereby reducing the weight of the largest item allowing for one person handling.

A factory assembled composite frame is provided on which the multiple glazing panels are secured after the frame has been placed in the roof opening. The glazing panels are accurately and quickly positioned on the frame through use of locator jigs along the top and outside edges. The locator jigs are removed after mounting flanges are screwed in place along the bottom side followed by mounting flanges being screwed in place around the remainder of the exterior periphery. A clip has legs received in channels of adjacent glazing panels to assure a proper predetermined spacing therebetween and to secure the panels to the support frame. A mullion width of up to three inches is possible.

The support frame is protected by a factory installed tight fitting boot which covers its entire exterior surface and includes a flange that extends down over the roof which in turn is taped to the roof along its exterior peripheral edge. Below adjacent glazing panel side edges is a vertical frame member in the support frame which includes a water weep channel covered with water resistant plastic. At the lower end of the channel the tape extends downwardly over the boot and is sealed with silicone sealant. The glazing panels include an exterior perimeter frame having oppositely facing twin channels. The horizontal top and bottom twin channels empty any water therein into the vertical frame channel. Any condensation will also be routed away from the window assembly.

DESCRIPTION OF THE PREFERRED EMBODIMENT

Figure 1:
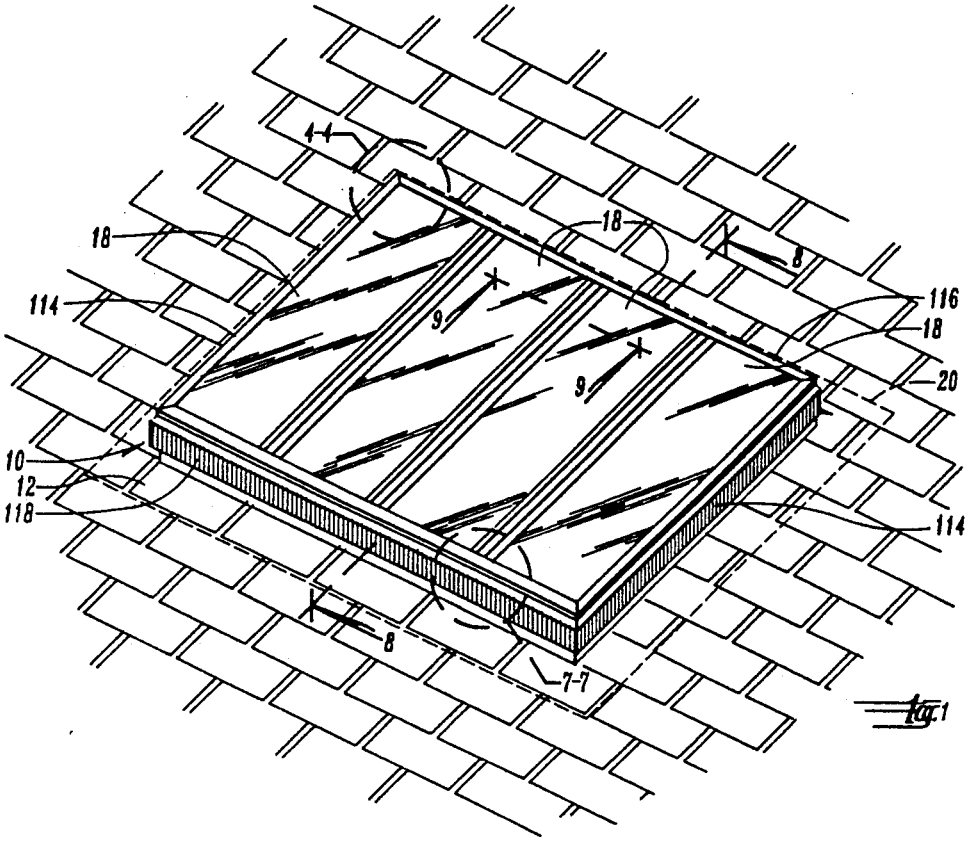
FIG. 1 is a fragmentary perspective view of the sunroof in the roof of a building.
Figures 2, 3:
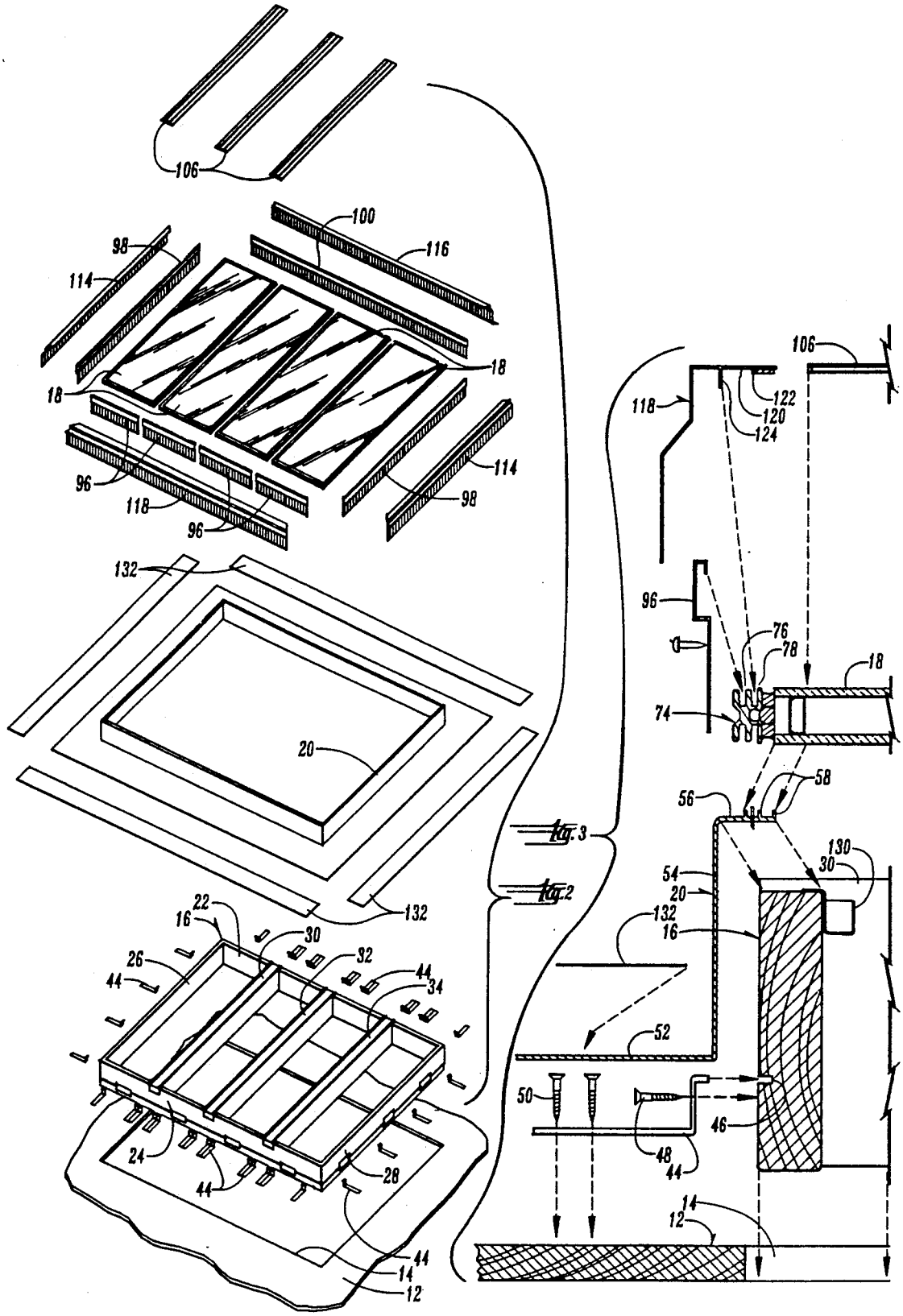
FIG. 2 is an exploded perspective view of the component parts for the sunroof.
FIG. 3 is a fragmentary cross-sectional exploded figure illustrating the component parts.

The sunroof of this invention is referred to generally in FIG. 1 by the reference numeral 10 and is shown mounted in a roof 12 having an opening 14 as seen in FIG. 2.

The sunroof 10 includes a composite one-piece support frame 16 sized to support four glazing panels 18. An EPDM boot membrane flashing 20 substantially covers the support frame 16.

Figure 7:
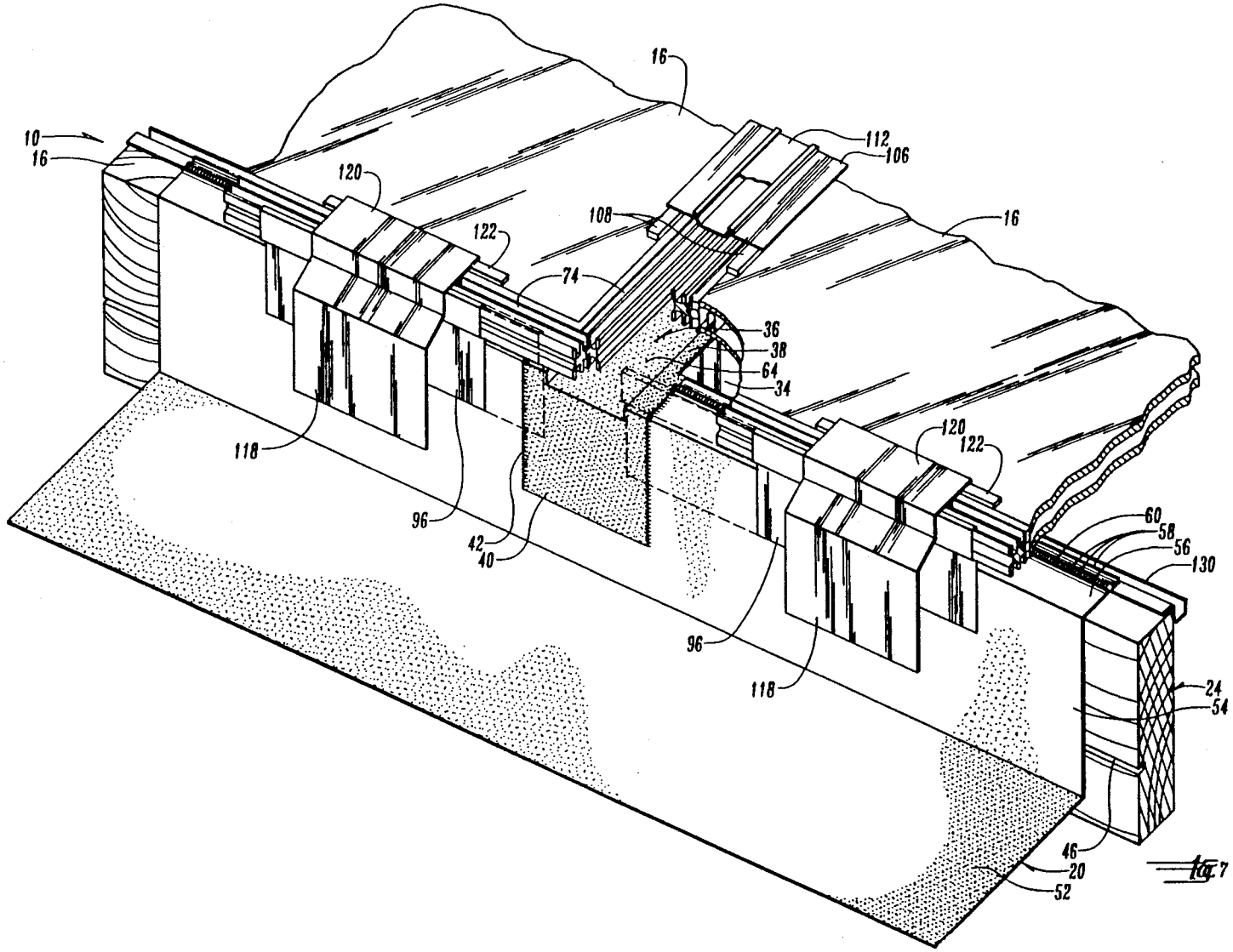
FIG. 7 is an enlarged detail fragmentary perspective view of the lower end of the sunroof as indicated by the lines 7—7 in FIG. 1.

The support frame 16 includes top and bottom frame members 22 and 24 and opposite side frame members 26 and 28. Support frame members 30, 32 and 34 extend between the top and bottom frame members 22 and 24 and include in the top surface a drain channel 36. The channel 36 is protected from moisture by a waterproof membrane 38 as seen in FIG. 7 which includes a flap 40 extending downwardly over the boot 20 and adhesively secured thereto by silicone sealant 42. The boot is cutaway under the flap 40 to allow free flow of water from the channel 36.

The support frame 16 is positioned in the opening 14 of the roof 12 and secured to the roof 12 by mounting brackets 44 received in a notch 46 in the frame 16 and held by screws 48. The bracket 44 is then secured to the roof 12 by screws 50.

Figure 8:
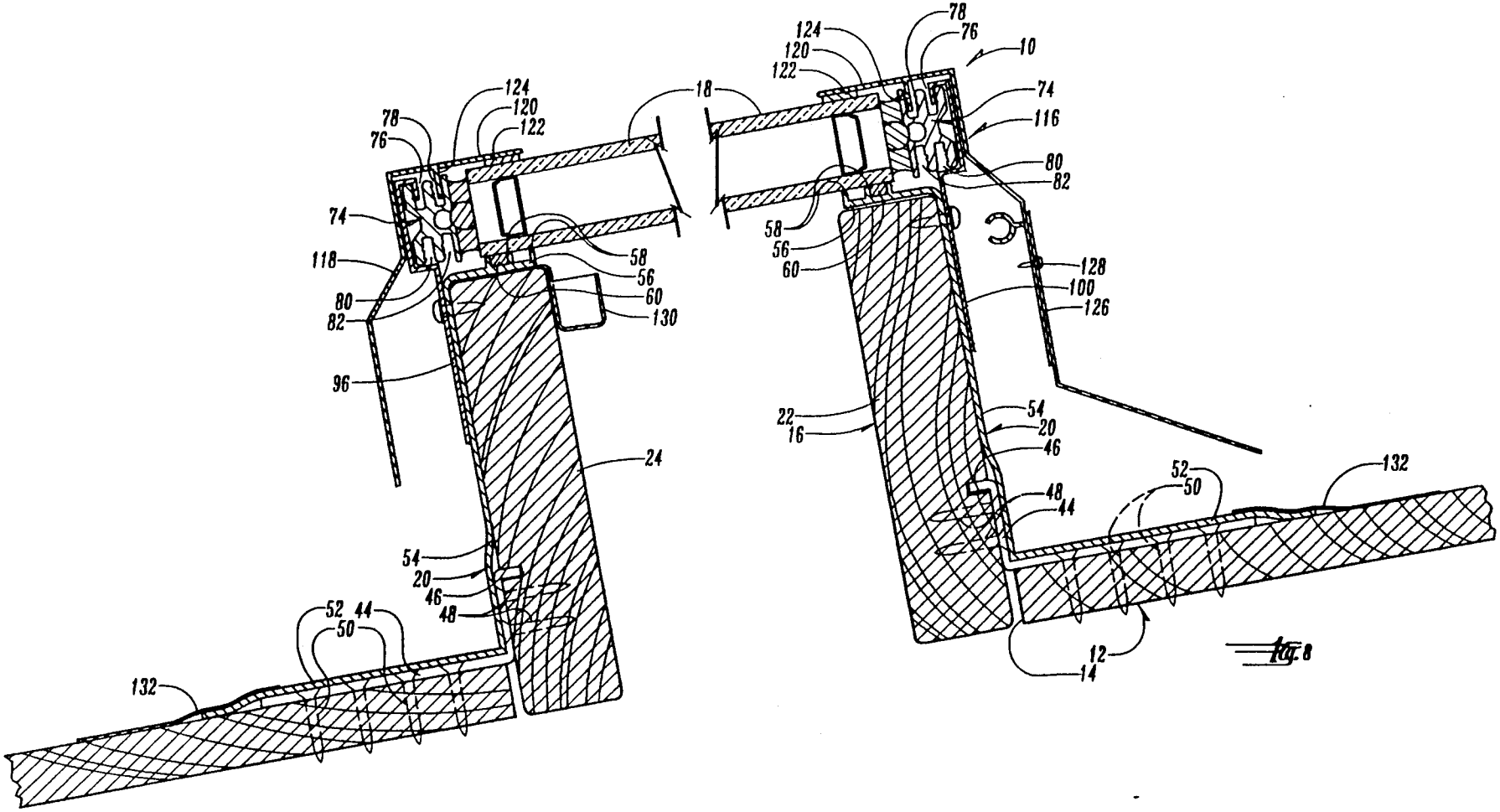
FIG. 8 is a fragmentary cross-sectional view taken along line 8—8 in FIG. 1.

The boot 20 includes a horizontal portion 52 merging into a vertical portion 54 in turn merging into a horizontal portion 56 extending over the top edge of the support frame 16. Three upstanding ribs 58 are provided on the portion 56 to receive silicone sealant 60 as seen in FIGS. 7 and 8 to provide a seal with the glazing panel 18.

Figure 9:
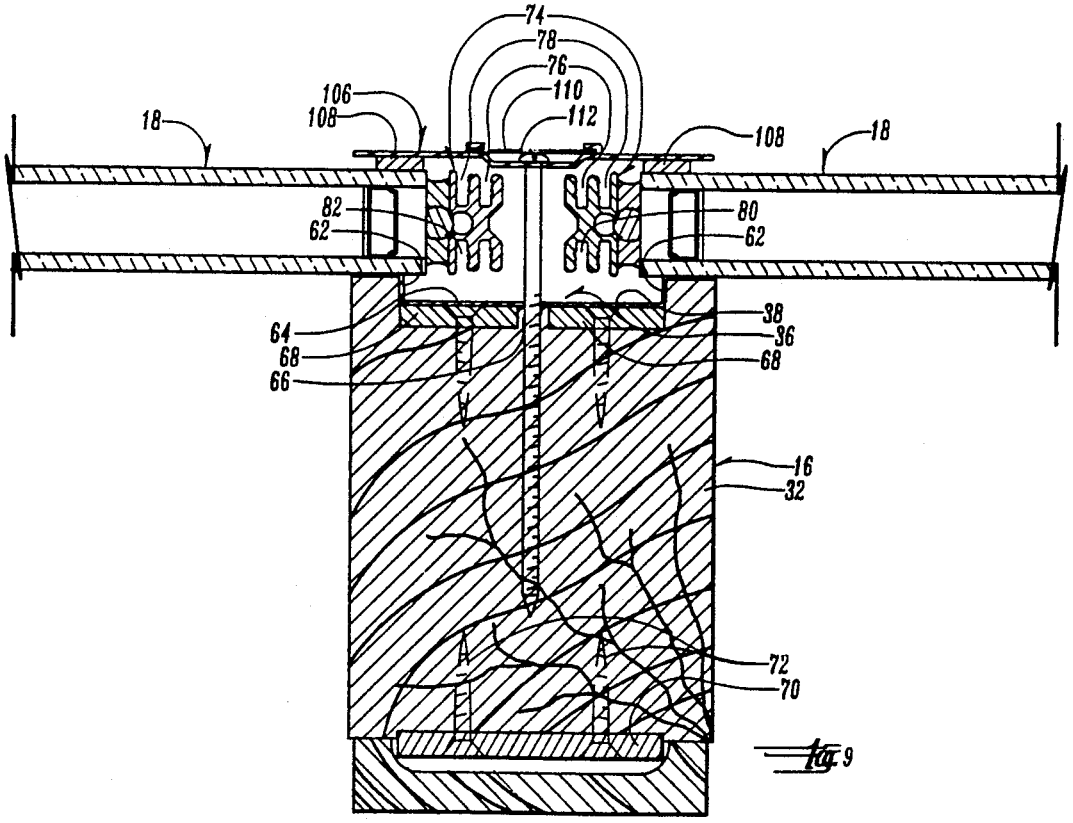
FIG. 9 is a fragmentary cross-sectional view taken along line 9—9 in FIG. 1.

The support frame members 30, 32 and 34 which give the appearance of beams from the room side are used in Rolscreen Company sunrooms as disclosed in the Mearl Minter U.S. Pat. No. 5,007,215 as seen in FIG. 9. The beam 32 is of laminated wood and includes the upwardly facing channel 36 on its top side. The channel has sidewalls 62 and a base 64. The base 64 includes an upstanding center ridge 66 of wood which spaces apart a pair of steel plates 68 which strengthen the beams and balance them against a strengthening plate 70 on the bottom side held by screws 72.

Figures 4, 5, 6:
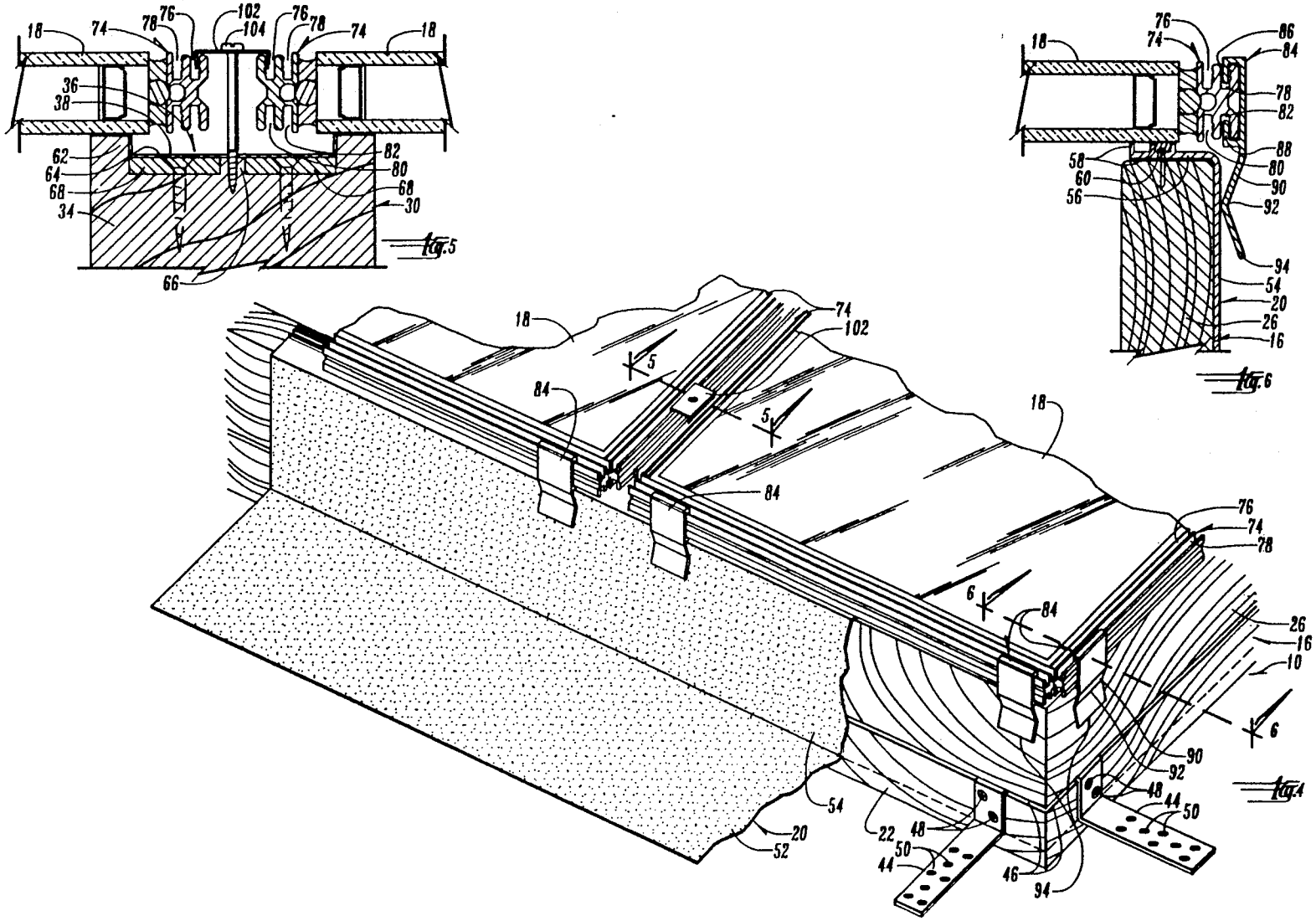
FIG. 4 is a fragmentary enlarged detail view of the upper end of the sunroof as indicated by the line 4—4 in FIG. 1.
FIG. 5 is a cross-sectional view taken along line 5—5 in FIG. 4 illustrating the clip for connecting and spacing the glazing panels and securing them to the support frame.
FIG. 6 is a fragmentary cross-sectional view taken along line 6—6 in FIG. 4 illustrating the use of the locator jig for positioning the glazing panels on the support frame during installation.

The glazing panels 18 include a peripheral frame 74 having a pair of upwardly facing channels 76 and 78 and downwardly facing channels 80 and 82 as seen in FIG. 5. The horizontal channels 76 and 78 as seen in FIG. 8 have multiple functions including serving as drain channels which empty into the channels 36 as seen, for example, along the lower edge of the glazing panels in FIG. 7. Drainage occurs at the top of the panels 18 in a similar manner.

The assembly of the glazing panels 18 to the support frame 16 involves utilizing a locator jig 84 along the top and exterior side edges as seen in FIG. 4. The locator jigs 84 include oppositely extending legs 86 and 88 received in the oppositely facing channels 78 and 82. The jig is adapted to be slid onto the glazing panel exterior frame from any corner as seen in FIG. 4. A downwardly extending leg 90 extends toward the support frame 16 and contacts it at the juncture 92 with an outwardly extending portion 94. It is seen that the locator jigs 84 hold the glazing panel 18 from sliding down the roof and accurately position it on the support frame 16.

A sill mounting flange 96 is then screwed to the bottom support frame 24 and engages the bottom glazing panel frame. The mounting flanges 96 as seen in FIG. 7 terminate at drain channels 36. A side mounting flange 98 is then installed followed by removal of the locator jigs 84 and installation of the head mounting flange 100 upon all of the glazing panels 18 having been installed. The glazing panels 18 are spaced a predetermined distance apart as determined by a connecting clip 102 as seen in FIG. 5 which has downwardly extending legs received in the upwardly facing channel 76 of the glazing panel perimeter frame. A screw 104 extending through the clip 102 secures the glazing panels 18 to the beam 34.

The next step involves adding the counter flashing 114 along the exterior sides, 116 along the top, and 118 along the bottom. As seen in FIG. 8, the counter flashing 116 includes a top horizontal portion 120 having a foam seal 122 engaging a top face of the glazing panel 18 and a downwardly extending leg 124 extends into the channel 78 of the glazing panel perimeter frame. The remainder of the flashing extends downwardly and outwardly toward the roof 12 and includes an adjustable portion 126 which may be positioned as desired by operation of an adjustment screw 128. The other flashing pieces are attached in a similar fashion although do not have the adjustment feature.

A mullion cover 106 having foam seals 108 sealingly engage the top face of the glazing panels 18 as seen in FIG. 9. A screw 110 secures the cover 106 to the support frame member 32 and is in turn covered by a mullion strip 112.

As also seen in FIG. 8, a condensation trough 130 is mounted on the bottom support frame member 24 at the lower end of the glazing panels 18. Waterproof tape 132 covers the outer horizontal flange 52 of the boot 20 securing it to the roof 12.

It is thus seen that through use of a composite factory assembled multiple window unit support frame 16 up to four glazing panels 18 may be mounted in a roof opening 14. Size and weight are the only limitations. A chance of misassembly is minimized by all component parts required for the sunroof installation being provided ready to be used without further fabrication being required. The sunroof is positively sealed against leakage through use of the protective boot 20 and the beam drain channels 36 between and under the adjacent edges of each pair of glazing panels 18. The use of the locator jigs 84 assures that the glazing panels are accurately positioned on the support frame and held there while the mounting flanges are installed.

We claim:

1. A sunroof comprising, a frame assembly including top, bottom and opposite side frame members, and at least one support frame member between said opposite side frame members, extending between said top and bottom frame members, said support frame member having upper and lower ends and top and bottom sides with a channel formed in the top side extending longitudinally of said support frame member for receiving water, said channel having opposite ends and being open at the end adjacent said bottom frame member for water to drain from said channel when said sunroof is disposed on an incline in a roof, glazing panels having adjacent side edges supported on the top side of said support frame member and overlaying said channel, and said glazing panels including horizontal, laterally extending drainage means positioned to empty into said channel for delivery of water to the lower end of said support frame member.

2. The structure of claim 1 wherein said frame assembly is unitary and adapted to be installed in a roof opening.

3. The structure of claim 2 wherein said bottom frame member includes inside and outside planes with said channel extending across said bottom frame member to the outside plane.

4. The structure of claim 3 and a one piece flexible elastomer boot membrane flashing extends around said frame assembly from said glazing panels outwardly for engagement with a roof to seal said roof from moisture passing therethrough.

5. The structure of claim 4 wherein said boot is fitted around said channel for water in said channel to empty onto said boot whereby said frame is protected from moisture.

6. The structure of claim 5 and a water resistant protective coating is provided in said channel.

7. The structure of claim 6 wherein said water resistant protective coating extends over said boot on the bottom frame member.

8. The structure of claim 1 wherein said channel is further defined as extending over said bottom frame member.

9. The structure of claim 8 and a mounting flange extends along said bottom frame member connecting said glazing panel to said frame assembly.

10. The structure of claim 9 wherein said mounting flange terminates at said channel.

11. The structure of claim 10 wherein said mounting flange is one of a pair of mounting flanges extending along said bottom frame member, each mounting flange being positioned on opposite sides of said channel and extending to adjacent said channel.

12. The structure of claim 11 and a single mounting flange extends along the substantial length of said top frame member connecting said glazing panels to said frame assembly.

13. The structure of claim 12 and side mounting flanges extend along said opposite side frame members connecting said glazing panels to said frame.

14. The structure of claim 13 and counter flashing extends along said top, bottom and opposite side frame members from over said glazing panels downwardly over said mounting flanges.

15. The structure of claim 1 and a mullion cover is provided on the adjacent side edges of said glazing panels and over said channel of said support frame member, and a screw means extends from said mullion cover into anchoring engagement with said support frame member to lock said panels to said frame assembly.

16. The structure of claim 1 and said adjacent side edges of said glazing panels have upwardly facing channels in which downwardly extending legs of a clip are received, to lock said glazing panels together in a predetermined spaced relationship.

17. The structure of claim 16 and a screw means extends from said clip into engagement with said support frame member to lock said glazing panels to said frame assembly.

18. The structure of claim 17 and a mullion cover is provided on the adjacent side edges of said glazing panels and over said clip and said channel.

19. The structure of claim 18 and screw means extends from said mullion cover into anchoring engagement with said support frame member.

20. The structure of claim 1 wherein said channel includes opposite sidewalls and a base, and said channel is substantially open between said sidewalls and below said glazing panels.

21. A room comprising, a frame support structure including a sunroof having at least one support frame member, said support frame member being elevated at one end and extending downwardly at its other end, said support frame member having top and bottom sides and being constructed of wood and including a channel shaped top side extending longitudinally of said support frame member for receiving water, and a pair of spaced apart metal reinforcement plates extending the substantial length and longitudinally of said support frame member in the bottom of said channel and fixedly secured to said support frame member whereby water received in said channel is adapted to run operatively over said plates to the other end of said support frame member.

22. The structure of claim 21 wherein a longitudinally extending reinforcing plate is fixedly secured to and is in substantial contact with the bottom side of said support frame member to balance the support frame member relative to the plates on the top side.

23. The structure of claim 21 wherein a longitudinally extending upstanding ridge of wood extends between said pair of plates in said channel and receives a wood screw for securing a mullion cover to said frame member for holding adjacent ends of glazing panels in place above said channel.

24. The structure of claim 21 wherein said top side of said support frame member is covered with a water resistant coating for protecting said wood frame member from moisture and to provide a drain channel for moisture in said channel.

25. A room comprising, a frame support structure including a sunroof having at least one support frame member, said support frame member being elevated at one end and extending downwardly at its other end, said support frame member having top and bottom sides and including a channel shaped top side extending longitudinally of said frame member for receiving water, said roof including glazing panels having adjacent side edges supported on the top side of said support frame member and overlaying said channel, and said glazing panels including horizontal laterally extending drainage means positioned to empty into said support frame member channel for delivery of water to the other end of said support frame member.

26. The structure of claim 25 wherein said support frame member is made of wood and said top side of said frame member is covered with a water resistant coating for protecting said wood support frame member from moisture.

27. The structure of claim 25 and a mullion cover is provided on top of the edges of the glazing panels and screw means extends from said cover between said panel edges into anchoring engagement with said support member to lock said panels to said support member.

28. The structure of claim 25 wherein said drainage means has a primary drain which includes a glazing horizontal perimeter frame including an upwardly facing channel extending along one horizontal edge of said glazing panel laterally to said frame member for draining water into said support frame member channel.

* * * * *